United States Patent [19]

Redding et al.

[11] Patent Number: 4,643,205

[45] Date of Patent: Feb. 17, 1987

[54] SMOKING PRODUCT

[75] Inventors: Jerry W. Redding, Lexington; Donald L. Roberts; Donna K. Woods, both of Winston-Salem, all of N.C.

[73] Assignee: R. J. Reynolds Tobacco Company, Winston-Salem, N.C.

[21] Appl. No.: 576,305

[22] Filed: Feb. 2, 1984

[51] Int. Cl.[4] ..... A24D 3/00

[52] U.S. Cl. ..... 131/275; 131/274; 131/276

[58] Field of Search ..... 131/335, 274, 275, 361, 131/276, 362

[56] References Cited

U.S. PATENT DOCUMENTS

| | | | |
|---|---|---|---|
| 1,507,925 | 9/1924 | Marshall, Jr. . | |
| 2,033,791 | 3/1936 | Sulzberger . | |
| 3,006,347 | 10/1961 | Keaton . | |
| 3,397,700 | 8/1968 | Harlow et al. . | |
| 3,483,872 | 12/1969 | Laporte . | |
| 3,589,371 | 8/1971 | Laporte . | |
| 3,723,410 | 3/1973 | Persinos . | |
| 4,082,858 | 4/1978 | Morita et al. . | |
| 4,123,592 | 10/1978 | Ranier et al. . | |
| 4,171,430 | 10/1979 | Matsushita et al. . | |
| 4,184,495 | 1/1980 | Ranier et al. . | |
| 4,236,532 | 12/1980 | Schweitzer et al. . | |
| 4,300,576 | 11/1981 | van der Loo | 131/335 |
| 4,340,074 | 7/1982 | Tudor . | |
| 4,361,697 | 11/1982 | Dobberstein et al. . | |

OTHER PUBLICATIONS

*Tobacco Flavoring for Smoking Products* by Leffingwell et al, dated 1972; published by R. J. Reynolds Tobacco Company, pp. 7,57,58,59 and 63 cited.

*Primary Examiner*—V. Millin
*Attorney, Agent, or Firm*—Herbert J. Bluhm

[57] ABSTRACT

A smoking product having an improved flavor is prepared by applying a naturally occurring terpenoid glycoside sweetener to the portion of the product that is intended to be contacted by the smoker's lips.

24 Claims, No Drawings

SMOKING PRODUCT

TECHNICAL FIELD

This invention relates to a smoking product which provides improved flavor and satisfaction to the user of such product.

BACKGROUND ART

The incorporation of flavoring materials into tobacco products has been widely practiced in the art for many years. The traditional method employed for incorporating these materials has been the direct application of flavorants to the tobacco. In the case of smoking products such as filter cigarettes, flavoring materials have also been applied to the combustible paper wrap which envelops the tobacco and to the filter tow from which the filter is made. Each of these methods leads directly to flavoring of the tobacco smoke that reaches the mouth of the smoker.

Another technique for providing flavoring effects in tobacco products involves the application of flavoring materials to the mouthpieces associated with those products so that the flavors are transferred to the mouth of the smoker separately from the tobacco smoke. This technique is exemplified by the invention disclosed in U.S. Pat. No. 1,507,925 which is directed to a cigarette that is provided with a flavored coating on the exterior surface of the end that is to be contacted by the smoker's lips. The specific flavoring materials disclosed include licorice, peppermint, spearmint and cinnamon applied in the form of a gelatin base.

A further disclosure of interest is found in U.S. Pat. No. 2,033,791 which involves the application of a "lipproof" composition to the mouth end of a cigarette. This composition is based on nitrocellulose in combination with a suitable flattening agent and the patent teaches incidentally that aromatic substances such as menthol, eucalyptus, oil of cloves and tobacco-aroma may be incorporated into the composition.

U.S. Pat. No. 3,397,700 discloses flavor enhanced cigars and cigarettes which have water soluble salts of glutamic acid or 5'-nucleotides applied to the mouth end thereof. The salts are typically applied to the exterior surface of the mouthpiece tipping sheet.

A thermoplastic cigar tip is described in U.S. Pat. Nos. 3,483,872 and 3,589,371 which is molded from a polyolefin resin that contains a suitable flavoring agent. Among the flavoring agents disclosed are artificial coffee flavor, fruit flavors, liqueur flavors, spices, aromatics vanilla, maple menthol, peppermint licorice as well as synthetic sweeteners such as saccharin, sodium saccharin, calcium cyclamate and sodium cyclamate.

Disclosed in U.S. Pat. Nos. 4,123,592 and 4,184,495 is a process for incorporating volatile flavorants into paper such as cigarette tipping to produce a flavorant-impregnated paper that does not release the flavorant until the paper is contacted with either heat or moisture. The volatile flavorants mentioned in these patents are benzaldehyde, methyl salicylate, cinnamaldehyde, acetophenone, menthol, anisole, amyl acetate, eucalyptol, caryone, anethole and fruit extracts (e.g., lime, orange and cherry).

BRIEF SUMMARY OF INVENTION

This invention provides a smoking product which is characterized by a perception of improved flavor when the product is smoked.

It is a principal object of this invention to provide a smoking product capable of transferring flavoring materials directly to the mouth of the user of such product without previous contact with the smoke that is drawn into the smoker's mouth.

A further object of this invention is to provide a smoking product which allows flavoring materials to be introduced into the mouth of the user of such product without subjecting the flavoring materials to a distillation or aerosol formation process.

Other objects and advantages will be apparent from the detailed description which follows.

DETAILED DESCRIPTION OF THE INVENTION

This invention involves a smoking product that is adapted to deliver certain flavoring materials directly to the mouth of the user of such a product. It has been unexpectedly discovered that application of certain flavoring materials to the external surface of the mouthpiece or mouth end of the smoking product provides a salivating effect and leaves a clean, refreshing taste in the mouth of the smoker. These flavoring materials comprise certain naturally occurring sweeteners which are characterized as being terpenoid glycosides which, on hydrolysis, yield glucose. Naturally occurring sweeteners which are suitable for the purposes of this invention also include terpenoid glycosides containing monosaccharides other than glucose provided that at least one glycosidic linkage involving glucose is present in the molecule. These terpenoid glycosides should exhibit at least a low degree of solubility in water and should possess a sweetening effect that is at least three times that of sucrose.

Particularly preferred sweeteners which may be used in accordance with the present invention are a number of diterpene glycosides which occur naturally in the plant *Stevia rebaudiana* and which exhibit a sweetness that far exceeds that of sucrose. These diterpene glycosides all contain a glucose moiety and have been previously described in the literature including U.S. Pat. Nos. 3,723,410, 4,082,858 and 4,361,697, the teachings of which are incorporated herein by reference. The sweetening agents produced by the *S. rebaudiana* plant include stevioside, steviolbioside, dulcoside A and rebaudiosides A, B, C, D and E, the structures of which are given in U.S. Pat. No. 4,361,697. These glycosides are usually recovered from the *S. rebaudiana* plant by extracting the plant material with a polar solvent such as water. The individual glycosides can be separated and purified by techniques well known in the art and used in purified form as sweeteners. It is preferred, however, that the *S. rebaudiana* plant extract be purified only to the extent necessary to separate and recover the diterpene glycoside fraction. The resulting mixture of diterpene glycosides provides the desired sweetening effect and renders the rather costly separation and recovery procedures for individual glycosides unnecessary. The water-solubility of the individual diterpene glycosides is somewhat limited due to their high molecular weights but this low solubility poses no particular problem because only very small amounts of the glycosides are required to provide a substantial sweetening effect.

The naturally occurring sweeteners described above are applied in any convenient manner to the portion of the smoking product that will contact the smoker's lips. For example, a solution of the desired sweetener or sweeteners in an aqueous medium or a suitable organic solvent such as ethyl alcohol, propyl alcohol, propylene glycol, etc. may be applied to the exposed surface of a cigar or cigarette wrapper by spraying, transfer rolls and other devices known in the art. The sweetener(s) may also be applied to a tipping sheet that circumferentially surrounds the mouth end of the smoking product. This technique is especially preferred in the case of filter cigarettes which normally employ tipping paper for attaching the filter to the tobacco rod. The sweetener may also be incorporated into a suitable lip-release formulation that is routinely used in the art for treating the outer surface of the tipping paper. The lip-release formulation may be applied by rotogravure methods or similar techniques and the coated tipping paper is then used in the conventional way to manufacture filter cigarettes.

The quantity of naturally occurring sweetener that is applied to the mouthpiece or mouth end of the smoking product will depend to some extent on the particular sweetener being used, its degree of purification, the method of application and the type of smoking product being produced. For cigarettes and similar products the application of *S. rebaudiana* sweetening agents at levels of approximately 7 micrograms per square centimeter of paper to the mouth end of each cigarette has been found to be effective. Application levels may range up to 30 micrograms per square centimeter although the preferred level is between 10 and 20 micrograms per square centimeter of paper. Application of similar levels to the mouth end of the wrapper for a non-filter cigarette, cigar or cigarillo would provide a similar effect on the flavor of such products. The smoking products which benefit from the use of this invention include not only those based on tobacco but also those containing reconstituted tobacco and/or tobacco substitutes.

For a better understanding of the present invention, reference will now be made to the following examples which describe in detail the manner in which this invention may be practiced.

EXAMPLE 1

Filter tipped cigarettes were prepared using a commercially available tipping paper for attaching the filters to the tobacco rods. The tipping paper was previously treated with a 2.67 percent ethanolic solution of a partially purified mixture of diterpene glycosides extracted from *Stevia rebaudiana* plant materials. The principal components of this sweetener mixture were stevioside and rebaudioside A. The ethanolic solution was applied to the tipping paper web by rotogravure printing techniques using a 165 NP Knurl printing cylinder to give a tipping paper having one side thereof coated with the sweetener mixture. The quantity of sweetener applied to the one side of tipping paper was approximately 0.015 milligrams per square centimeter of tipping paper. The tipping paper was applied to the filter in such a way that the coated side of the paper formed the outer surface of the mouth end of the assembled cigarette. Control cigarettes were also prepared which were identical to the test cigarettes except that no sweetener mixture was applied to the tipping. The test and control cigarettes were then evaluated by a panel of 8 expert smokers in a comparison smoking test. Seven of the 8 panelists expressed a preference for the test cigarette declaring it to have more flavor with a cleaner and smoother taste.

EXAMPLE 2

The procedure of Example 1 was repeated except that the diterpene glycoside mixture was incorporated into a commercially available lip release formulation having a nitrocellulose base. The concentration of diterpene glycosides in the resulting mixture was approximately 2.67 percent by weight and the mixture was applied in sufficient amounts by the rotogravure method to give a coated tipping paper having about 0.015 milligrams per square centimeter of the diterpene glycoside sweeteners applied to one side of the paper. A comparison smoking test of filter cigarettes prepared with the sweetener-coated tipping versus a control cigarette indicated a strong preference for the test cigarette.

What is claimed is:

1. A smoking product comprising a charge of smokable material enveloped by a combustible wrapper with a section of said wrapper adapted to be contacted by a smoker's lips, said section being treated with a flavoring material which comprises a naturally occurring terpenoid glycoside sweetener which is capable of yielding glucose on hydrolysis.

2. The product of claim 1 wherein said section of said wrapper is provided with tipping paper treated with said flavoring material.

3. The product of claim 1 or 2 wherein said sweetener is a diterpene glycoside produced by the plant *Stevia rebaudiana.*

4. The product of claim 3 wherein said diterpene glycoside comprises stevioside.

5. The product of claim 3 wherein said diterpene glycoside comprises rebaudioside A.

6. A cigarette comprising a paper-wrapped rod of smokable material and a mouthpiece affixed to one end of said rod by tipping paper adapted to be contacted by a smoker's lips, the surface of said tipping paper that is contacted by the smoker's lips being treated with a flavoring material comprising a naturally occurring sweetener that is a terpenoid glycoside containing a glucose moiety.

7. The cigarette of claim 6 wherein said mouthpiece includes a smoke filter.

8. The cigarette of claim 6 or 7 wherein said sweetener is a diterpene glycoside produced by the plant *Stevia rebaudiana.*

9. The cigarette of claim 8 wherein said diterpene glycoside comprises stevioside.

10. The cigarette of claim 8 wherein said diterpene glycoside comprises rebaudioside A.

11. The cigarette of claim 8 wherein the surface of said tipping paper is treated with between 7 and 30 micrograms of sweetener per square centimeter of tipping paper.

12. A method for improving the flavor of a smoking product which comprises providing the smoking product with a mouthpiece having an exposed surface area adapted to be contacted by a smoker's lips and applying to said surface area an effective amount of a flavoring material comprising a naturally occurring terpenoid glycoside sweetener which is capable of yielding glucose on hydrolysis.

13. The method of claim 12 wherein said mouthpiece includes tipping paper which provides said exposed surface area for said flavoring material.

14. The method of claim 13 wherein said mouthpiece includes a smoke filter and said smoking product is a cigarette.

15. The method of claim 12, 13 or 14 wherein said sweetener is a diterpene glycoside produced by the plant *Stevia rebaudiana.*

16. The method of claim 15 wherein said diterpene glycoside comprises stevioside.

17. The method of claim 15 wherein said diterpene glycoside comprises rebaudioside A.

18. The method of claim 15 wherein the amount of sweetener applied to said surface area is between 7 and 30 micrograms per square centimeter.

19. A process for manufacturing a filter cigarette having an improved flavor which comprises (a) treating one side of a web of tipping paper with a lip-release composition which includes an effective amount of a naturally occurring terpenoid glycoside sweetener containing a glucose moiety and (b) using the web of treated tipping paper in the manufacture of a filter cigarette.

20. The process of claim 19 wherein rotogravure techniques are used for applying said lip-release composition to the tipping paper.

21. The process of claim 19 wherein said effective amount of sweetener is sufficient to give a concentration of 7 to 30 micrograms of sweetener per square centimeter of tipping paper.

22. The process of claim 19, 20 or 21 wherein said sweetener is a diterpene glycoside produced by the plant *Stevia rebaudiana.*

23. The process of claim 22 wherein said diterpene glycoside comprises stevioside.

24. The process of claim 22 wherein said diterpene glycoside comprises rebaudioside A.

* * * * *